US006147479A

United States Patent [19]

Lee

[11] Patent Number: 6,147,479

[45] Date of Patent: Nov. 14, 2000

[54] VOLTAGE DOWN CONVERTER

[75] Inventor: Jung Seop Lee, Kyoungki-do, Rep. of Korea

[73] Assignee: Hyundai Electronics Industries Co., Ltd., Kyoungki-do, Rep. of Korea

[21] Appl. No.: 09/343,303

[22] Filed: Jun. 30, 1999

[30] Foreign Application Priority Data

Jun. 30, 1998 [KR] Rep. of Korea ..... 98-25949

[51] Int. Cl.[7] ..... G05F 3/04; G05F 3/16

[52] U.S. Cl. ..... 323/313; 323/314

[58] Field of Search ..... 323/313, 314, 323/315, 907; 327/535, 538, 539

[56] References Cited

U.S. PATENT DOCUMENTS 4,978,905 12/1990 Hoff et al. ..... 323/314
5,220,273 6/1993 Mao ..... 323/313
5,686,825 11/1997 Suh et al. ..... 323/316
5,818,212 10/1998 Min et al. ..... 323/314

*Primary Examiner*—Matthew Nguyen
*Attorney, Agent, or Firm*—Ladas & Parry

[57] ABSTRACT

A voltage down converter for converting an external power voltage into an internal power voltage and providing the internal power voltage to an internal circuitry, comprising: a reference voltage generation means for receiving the external power voltage and generating a constant reference voltage where variation of the external power voltage and change of circumstance temperature are compensated; a reference voltage converting means for converting the reference voltage from the reference voltage generation means into a reference voltage for stress mode or a reference voltage for normal mode; and a driving means for receiving the reference voltage from the reference voltage converting means to generate the internal power voltage required to operation of the internal circuitry.

9 Claims, 3 Drawing Sheets

VOLTAGE DOWN CONVERTER

BACKGROUND OF THE INVENTION

This invention relates to a voltage down converter of a memory device, and more particularly to an internal voltage down converter capable of reducing the effect of an internal voltage variation on an internal circuit.

In general, an internal voltage generation circuit which is referred to as a voltage down converter, generates a reference voltage of a comparator for a final current driver by using a voltage amplifier so as to compensate a level variation of an internal voltage caused by a noise in on-chip circuit operation or a process variation. Herein, the factor of the process variation is a threshold voltage or a saturation current or the like and the noise means a current spike which causes large current flow in a sensing circuit or an input/output circuit. The noise has an effect on an internal voltage circuit and hence causes variation of the predetermined reference voltage.

FIG. 1 shows a block diagram of an internal voltage circuit in the prior art. The internal voltage circuit includes a reference voltage generation portion 110 for stably supplying a constant reference voltage irregardless of an external circumstance variation such as a temperature and an external voltage variation or the like, a reference voltage converting portion 120 for receiving the reference voltage from the reference voltage generation portion 110 to convert a power voltage required according to a normal mode and a stress mode, and a driving portion 130 for receiving the power voltage from the voltage converting portion 120 to generate an internal voltage Vint for driving internal circuitry 140. The internal voltage circuit provides the internal voltage Vint to the internal circuitry as a power voltage.

The reference voltage generation portion 110 includes a first reference voltage generation means 111 for receiving an external voltage to generate a first reference voltage VR1 and a second reference voltage generation means 112 for receiving the first reference voltage generation means 111 to generate a second reference voltage VR2 which is a constant reference voltage and to provide it to the reference voltage conversion portion 120. In the reference voltage generation portion 110, a band-gap reference type generator or a widlar current source type generator as the first reference voltage generation means 111 is typically used.

The second reference voltage generation means 112 includes a comparator 113 which receives the first reference voltage as one input, a first current driver 114 which receives an output signal of the comparator 113 and generates the second reference voltage VR2 and resistors R1 and R2 for voltage-dividing the second reference voltage VR2 and providing the divided voltage Va to another input of the comparator 113.

The second reference voltage VR2 is voltage-divided through the resistors R1 and R2 and the divided voltage VA is fed back to another input of the comparator 113 so that the second reference voltage generation means 112 generates the constant reference voltage VR2.

The reference conversion portion 120 includes a second comparator 121 which the reference voltage VR2 from the reference voltage generation portion 110 is applied to one input thereof and an output of the reference conversion portion 120 is fed back to another input thereof, a second current driver 122 for receiving an output of the second comparator 121 to making a power voltage VR3 suitable to a normal mode as the output of the reference conversion portion 120, a bias generation means 126 for generating a constant bias VST for a stress mode, a third comparator which the bias voltage VST from the bias generation means 126 is applied to one input thereof and the output of the reference conversion portion 120 is fed back to another input thereof, and a third current driver for receiving an output of the third comparator 123 to make a power voltage suitable to a stress mode as the output VR3 of the reference voltage conversion portion 120. In the reference voltage conversion portion 120, the reference numerals 125 and 127 designate a current source, respectively.

In a normal mode, the reference voltage conversion portion 120 receives the reference voltage VR2 from the reference voltage generation portion 110 and the output VR3 thereof as two inputs of the second comparator 121 and generates the power voltage VR3 suitable to a normal mode through the second current driver 122 to the driving portion 130.

In a stress mode, the reference voltage conversion portion 120 receives the constant bias voltage VST from the bias generation means 126 and the output VR3 thereof as two inputs of the third comparator 123 and generates the power voltage VR3 suitable to a normal mode through the third current driver 124 to the driving portion 130. Herein, a normal mode is that a power voltage is 3.3V±10% and a stress mode is that a power voltage is above 1.5×3.3V.

In other words, in a normal mode, the second current driver 122 is turned on by the output of the second comparator and the third current driver 124 is turned off by the output of the third comparator 123, so that the output power voltage VR3 is maintained as the output reference voltage VR2 of the reference voltage conversion portion 120. In a stress mode, the second current driver 122 is turned off by the output of the second comparator 121 and the third current driver 124 is turned on by the output of the third comparator 123, so the power voltage VR3 is maintained as the constant bias voltage VST of the bias generation means 126. In general, the constant bias voltage VST is maintained at a value of Vcc(a power voltage)—nVt(herein, n is 2 in general).

The driving portion 130 is for supplying current corresponding to the respective operation modes of the internal circuitry 140. The driving portion 130 includes a fourth comparator 134 which receives the output power voltage VR3 from the reference voltage conversion portion 120 as one input thereof and the internal voltage Vint of the output of the driving portion 130 and a fourth current driver 131 for receiving an output of the fourth comparator 134 to generate the internal voltage Vint to the internal circuitry 140 in a standby mode. The driving portion 130 includes a fifth comparator 135 which receives the output power voltage VR3 from the reference voltage conversion portion 120 as one input thereof and the internal voltage Vint of the output of the driving portion 130 as another input thereof and a fifth current driver 132 for receiving an output of the fifth comparator 135 to generate the internal voltage Vint in an active mode in accordance with a clock ACT.

The fourth current driver 131 is a current driver for a standby mode which is operated when the power voltage Vcc is turned on and a fifth current driver 132 is a current driver for an active mode which is activated by the clock signal ACT. The fourth current driver which a pull down current sink 133 is connected between the output Vint thereof and a ground and the fifth current driver are voltage followers.

The internal circuitry is a on-chip circuit which uses the internal voltage Vint which is dropped from an external voltage Vcc.

However, the prior voltage down circuit has an disadvantage as follows. The resistors R1 and R2 of the reference voltage generation portion 110 is varied with external circumstance such as a noise or a temperature variation in an on-chip circuit operation and the reference voltage generated from the reference voltage generation portion 110 is varied so that the internal circuitry is affected by the reference voltage variation.

SUMMARY OF THE INVENTION

It is an object of the present invention to a voltage down circuit which prevents an internal voltage from changing by the variation of an reference voltage level.

According to an aspect of the present invention, there is provided to an a voltage down converter for converting an external power voltage into an internal power voltage and providing the internal power voltage to an internal circuitry, comprising: a reference voltage generation means for receiving the external power voltage and generating a constant reference voltage where variation of the external power voltage and change of circumstance temperature are compensated; a reference voltage converting means for converting the reference voltage from the reference voltage generation means into a reference voltage for stress mode or a reference voltage for normal mode; and a driving means for receiving the reference voltage from the reference voltage converting means to generate the internal power voltage required to operation of the internal circuitry.

The reference voltage generation means includes: a generation means for reference voltage, which receives the external power voltage to generate a voltage based on the external power voltage; and a voltage amplification means for receiving the reference voltage from the generation means to generate the reference voltage where variation of the external power voltage and change of circumstance temperature are compensated.

The voltage amplification means includes a voltage divider for voltage-dividing the reference voltage which is an output of the voltage amplification means; a comparator for comparing an output of the voltage divider and the output of the generation means; a current driver for generating the reference voltage where variation of the external power voltage and change of circumstance temperature are compensated in accordance with an output of the comparator; and a voltage level compensation means for compensating the reference voltage generated from the current driver to variation of the external power voltage and change of circumstance temperature.

The voltage divider is comprised of a first and a second resistors which is connected between the output of the current driver and a ground voltage and is for voltage-dividing the reference voltage generated from the current driver and providing a divided voltage to the comparator. The current driver is comprised of a PMOS transistor which the output of the comparator is applied to a gate thereof and is connected between the external power voltage and the output of the current driver.

The voltage level compensation means includes a compensation means for compensating the reference voltage from the current driver according to the divided voltage from the voltage divider; and a adjusting means for adjusting the divided voltage from the reference voltage to make the reference voltage generated the current driver have a constant level irregardless of variation of the external power voltage and change of circumstance temperature.

The compensation means is comprised of a NMOS capacitor connected with the first resistor in parallel and the adjusting means is comprised of a NMOS current sink for adjusting the divided voltage, which is connected with the second resistor in parallel.

There is also provided to a voltage down converter for converting an external power voltage into an internal power voltage and providing the internal power voltage to an internal circuitry, comprising: a reference voltage generation means for receiving the external power voltage and generating a constant reference voltage where variation of the external power voltage and change of circumstance temperature are compensated, the reference voltage generation means including a generation means for reference voltage, which receives the external power voltage to generate a voltage based on the external power voltage; and a voltage amplification means for receiving the reference voltage from the generation means to generate the reference voltage where variation of the external power voltage and change of circumstance temperature are compensated; a reference voltage converting means for converting the reference voltage from the reference voltage generation means into a reference voltage for stress mode or a reference voltage for normal mode; and a driving means for receiving the reference voltage from the reference voltage converting means to generate the internal power voltage required to operation of the internal circuitry.

There is still also provided to a voltage down converter for converting an external power voltage into an internal power voltage and providing the internal power voltage to an internal circuitry, comprising: a reference voltage generation means for receiving the external power voltage and generating a constant reference voltage where variation of the external power voltage and change of circumstance temperature are compensated, the reference voltage generation means including a generation means for reference voltage for receiving the external voltage to generate a voltage based on the external voltage; a voltage divider for voltage-dividing the reference voltage; a comparator for comparing an output of the voltage divider and the output of the generation means; a current driver for generating the reference voltage where variation of the external power voltage and change of circumstance temperature are compensated in accordance with an output of the comparator; a capacitor for compensating the reference voltage from the current driver according to the divided voltage from the voltage divider; and a NMOS current sink for adjusting the divided voltage from the reference voltage to make the reference voltage generated the current driver have a constant level irregardless of variation of the external power voltage and change of circumstance temperature; a reference voltage conversion means for the reference voltage from the reference voltage generation means into a reference voltage for stress mode or a reference voltage for normal mode; and a driving means for receiving the reference voltage from the reference voltage converting means to generate the internal power voltage required to operation of the internal circuitry;

wherein in case where the level of the reference voltage is higher than a desired voltage level, a resistance of the NMOS sink becomes decreased so that the divided voltage is lowered and the lowered divided voltage is provided to the comparator, thereby lowering the level of the reference voltage; and in case where the level of the reference voltage is lower than a desired voltage level, the resistance of the NMOS sink becomes increased so that the divided voltage is large and the large divided voltage is provided to the comparator, thereby increasing the level of the reference voltage.

BRIEF DESCRIPTION OF THE INVENTION

The objects and features of the invention may be understood with reference to the following detailed description of an illustrative embodiment of the invention, taken together with the accompanying drawings in which.

DETAILED DESCRIPTION OF THE INVENTION

Figure 2:
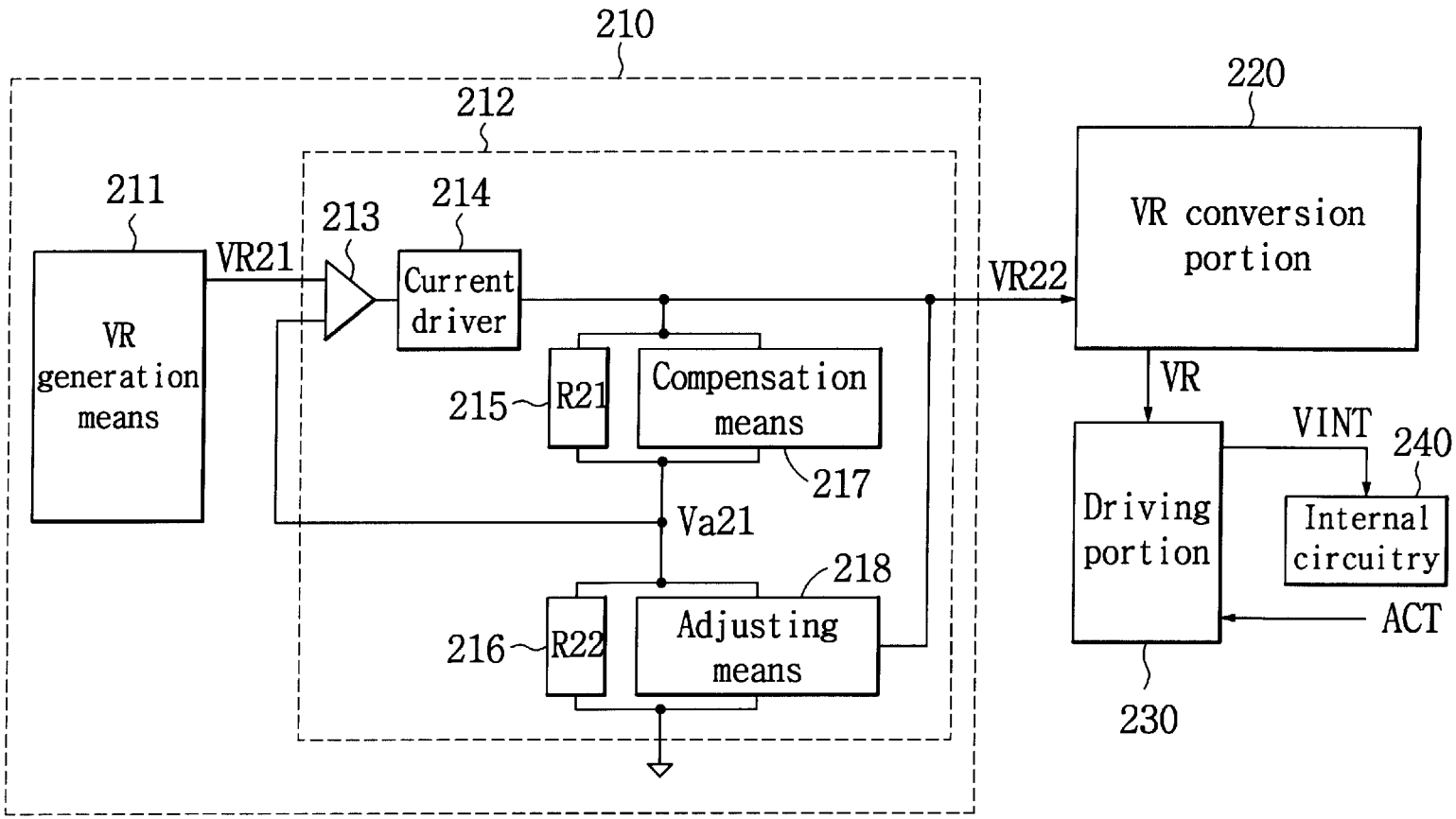
FIG. 2 is a circuit diagram of a voltage down circuit in accordance with an embodiment of the present invention.
Figure 3:
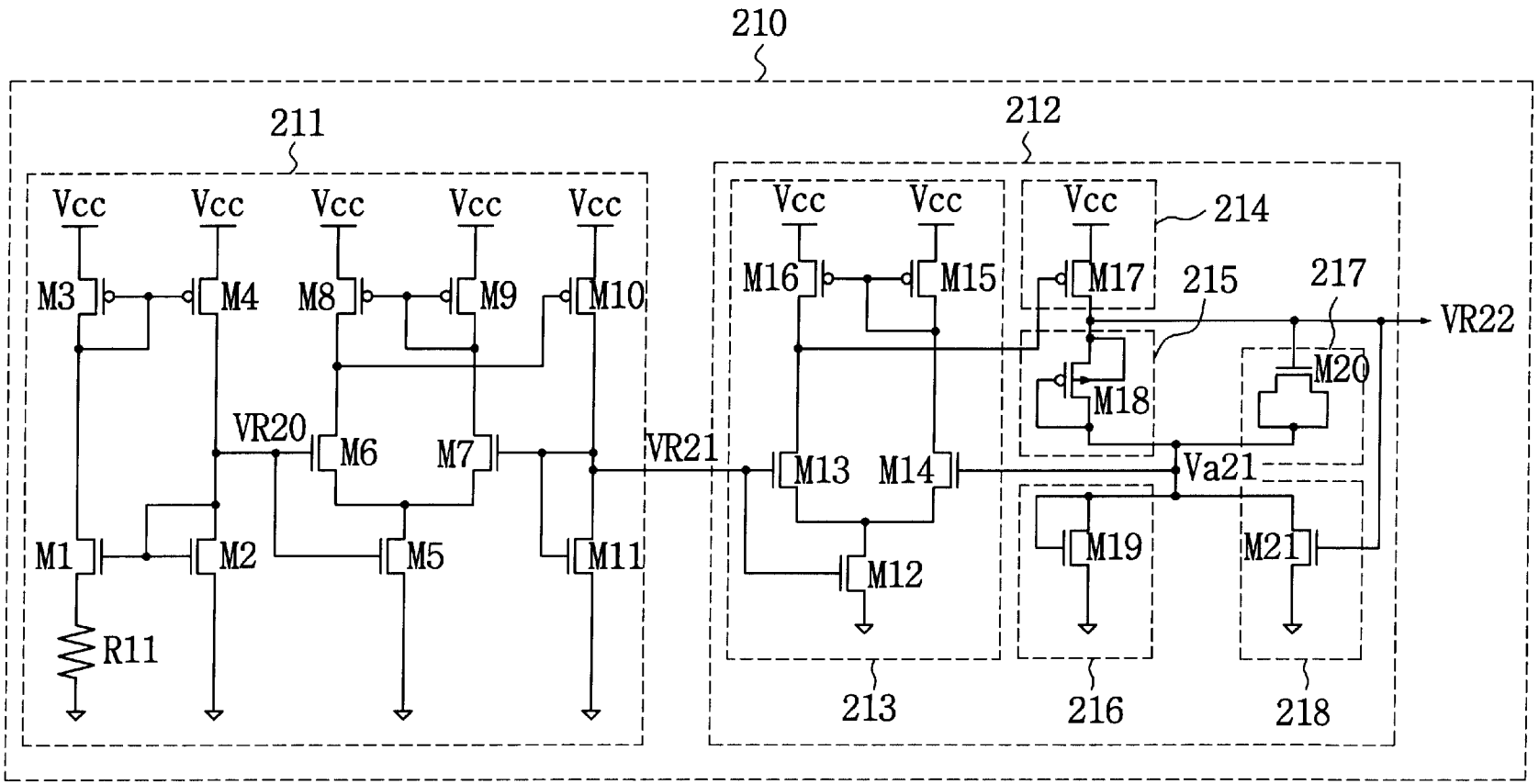
FIG. 3 is a detailed circuit diagram of the voltage down circuit of FIG. 2.

FIG. 2 is a circuit diagram of a voltage down circuit in accordance with an embodiment of the present invention and FIG. 3 is a detailed circuit diagram of the voltage down circuit of FIG. 2. Referring to FIG. 2 and FIG. 3, the voltage down circuit of the present invention includes a reference voltage generation portion 210 for stably supplying a constant reference voltage VR22 irregardless of an external circumstance variation such as a temperature, a noise, an external voltage variation or the like, a reference voltage converting portion 220 for receiving the reference voltage VR22 from the reference voltage generation portion 210 to convert a power voltage required according to a normal mode and a stress mode, and a driving portion 230 for receiving the power voltage from the voltage converter 220 to generate an internal voltage Vint for driving an internal circuitry 240. The voltage down circuit which is an internal voltage circuit provides the internal voltage Vint to the internal circuitry 240 as a power voltage.

The reference voltage generation portion 210 includes a reference voltage generation means 211 for receiving an external voltage Vcc to generate a first reference voltage VR21 and a voltage amplification means 212 for receiving the first reference voltage VR21 from the reference voltage generation means 211 to generate a second reference voltage VR22 which is a constant reference voltage irregardless of an external circumstance variation and is provided to the reference voltage conversion portion 220.

In the reference voltage generation portion 210, the reference voltage generation means 211 is comprised of PMOS transistors M3, M4, M8, M9 and M10 and NMOS transistors M1, M2, M5, M6, M7, M11 and generates the first reference voltage based on the external voltage Vcc. The voltage amplification means 212 includes a comparator 213 which receives the first reference voltage VR21 as one input, a current driver 214 which drives by an output signal of the comparator 213 and generates the second reference voltage VR22 having a constant level irregardless of a temperature variation or an external voltage variation as its output and a divider means for voltage-dividing the second reference voltage VR22 from the current driver 214 and providing the divided voltage Va21 to another input of the comparator 213.

In the voltage amplification means, the comparator 213 includes PMOS transistors for current mirror M15 and M16 where the external voltage is applied to source, respectively, NMOS transistors for differential amplification M13 and M14 where drains of the PMOS transistors M15 and M16 are connected to drains, respectively and for differential-amplifying the output VR21 from the reference voltage generation means 211 and the divided voltage Va21 from the divider means which are applied to gates thereof and for providing an output of the comparator 213 to the current mirror 214 and NMOS transistor M19 for current sink which sources of the NMOS transistors M13 and M14 are connected to a drain thereof, a source thereof is grounded and the output VR21 from the reference voltage generation means 21 is applied to a gate thereof.

The current driver 214 includes a PMOS transistor M17 where the output of the comparator 213 is applied to a gate, the external voltage is applied to a gate and a drain is connected to the resistor 215 of the divider means and generates the constant reference voltage VR22 irregardless of a temperature variation or an external voltage variation through the drain of the PMOS transistor M17.

The divider means includes resistors 215 and 216 connected between the output node VR22 of the current driver 214 and a ground in series and the resistor 215 is comprised of a PMOS transistor M18 for diode which is connected between the output node VR22 and the voltage dividing node Va21 and a gate and a drain thereof are commonly connected and the resistor 216 is comprised of a MOS transistor M19 for diode which is connected between the voltage dividing node Va21 and the ground and a drain and a gate are commonly connected.

The reference voltage generation portion 210 further includes a compensation means 217 connected in parallel with the resistor 215 and for determining a resistance of the resistor 215 so as to compensate the level of the reference voltage VR22 from the current driver 214 and a current adjusting means 218 connected in parallel with the resistor 216 and for determining a resistance of the resistor 216 so as to adjusting the current of the voltage dividing node Va21.

The compensation means 217 includes a capacitor between the output node VR22 of the current driver 214 and the voltage dividing node Va21 and the capacitor is comprised of a NMOS transistor M20 where the output node VR22 of the current driver 214 is connected to a gate and the voltage dividing node Va is connected to a source/drain.

The current adjusting means 218 includes a current sink connected between the voltage dividing node Va21 and a ground and the current sink is comprised of a NMOS transistor M21 where the output node VR22 of the current sink 214 is connected to a gate and a source and a drain are connected to a voltage diving node Va21 and a ground, respectively.

Figure 1:
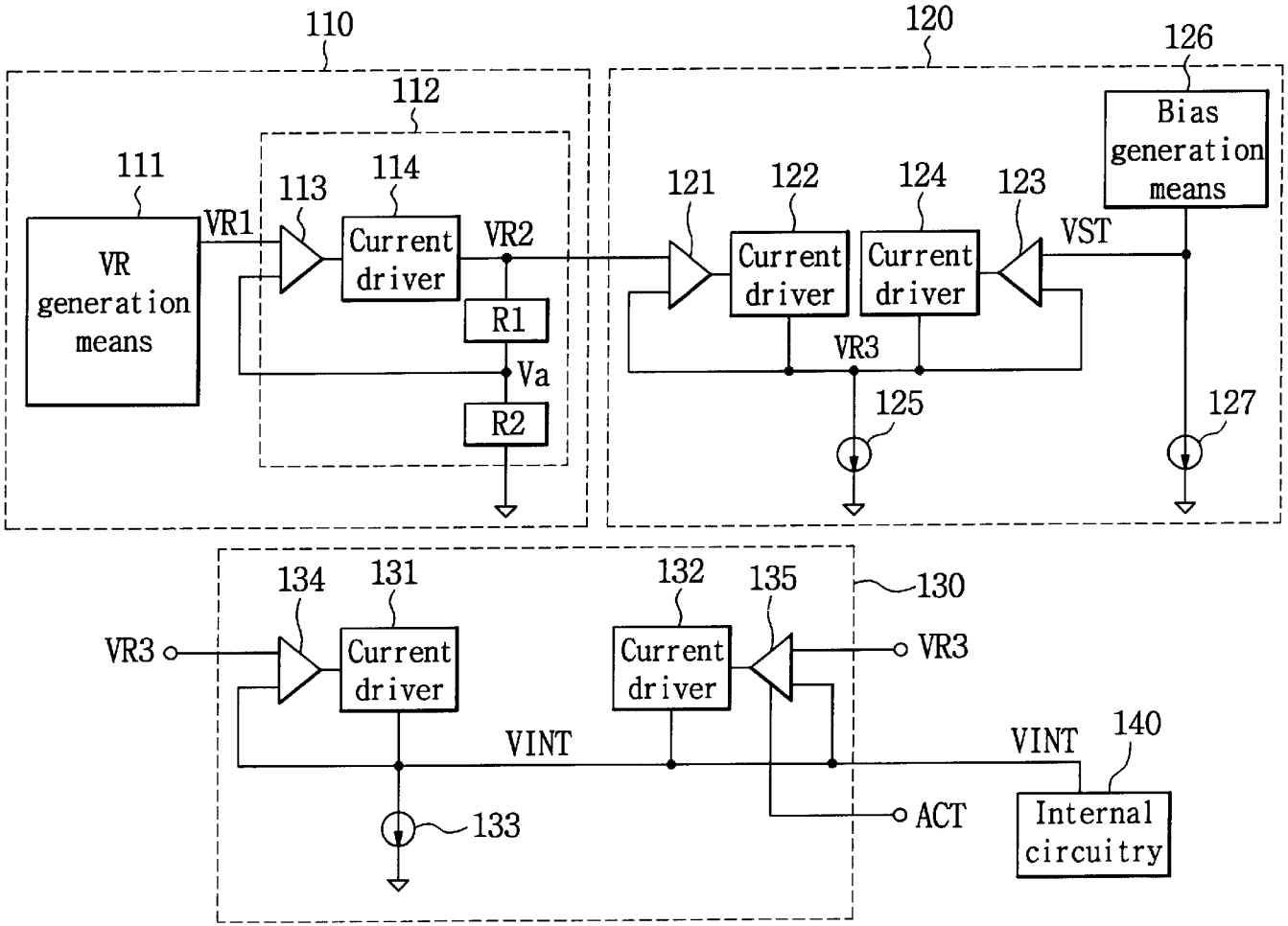
FIG. 1 (PRIOR ART)
FIG. 1 is a circuit diagram of a voltage down circuit in the prior art.

In the voltage down circuit, the reference voltage converting portion 220 and the driving portion 230 are operated as the reference voltage converting portion 120 and the driving portion 130 of FIG. 1 and will be omitted herein.

The operation of the reference voltage generation portion 210 will be described in more detail as follows.

The reference voltage generation portion 210 receives the external power voltage Vcc to generate the constant reference voltage VR22 irregardless of change of circumstance temperature and variation of the external power voltage. First, the reference voltage generation means 211 receives the external power voltage Vcc and generates the constant voltage VR20 through a Widlar current source which is constituted with transistors M1–M4 and a resistor R11.

At this time, the constant voltage VR20 generated through a Widlar current source is represented by the following equation (1)

$$VVR20=Vvt(N1)+2R1\ \beta2(1-1/K)$$

Herein, $K=\sqrt{(\beta1/\beta2)}$, $\beta1$ and $\beta2$ are values of the transistors M1 and M2.

From the equation (1), it should be noted that a Widlar current source provides the constant voltage VR20 if a threshold voltage of the transistor M1 and a resistance of the resistor R11 are constant.

The transistors M5 . M11 are voltage followers so that an output voltage VR21 of the reference voltage generation means 211 becomes the constant voltage VR20.

If the reference voltage VR21 generated from the reference voltage generation means 211 is provided to the voltage amplification means 212, the comparator 213 receives the reference voltage VR21 from the reference voltage generation means 211 and a divided voltage Va21 of a voltage divider means which is constituted with the resistors 215 and 216 as gate inputs of the NMOS transistors M13 and M14 and generates an output to drive the PMOS transistor M17 of the current driver 214.

The PMOS transistor M17 of the current driver 214 is driven by the output of the comparator 213 to generate the reference voltage VR22, which is provided to the reference voltage conversion portion 220 and is also fed back to the comparator 213 to compensate the level variation of the reference voltage VR22.

At this time, the reference voltage VR22 is varied by changing resistances of the resistors 215 and 216 due to circumstance temperature. If the level of the reference voltage VR22 is larger than a desired voltage level, the large reference voltage VR22 is provided to the gate of the NMOS transistor M21 of the current adjusting means 218 so that its resistance becomes lowered. Accordingly, as the resistance of the NMOS transistor M21 becomes lowered, a voltage of the node Va21 becomes lowered. The lowered voltage at the node Va21 is provided to the gate of the NMOS transistor M14 of the comparator 213 so that the level of the reference voltage VR22 generated through the PMOS transistor M17 of the current driver 214 is lowered. Therefore, when the level of the reference voltage VR22 generated through the current driver 214 is larger than the desired voltage level, the current sink 218 makes the level of the reference voltage VR22 lower through the NMOS transistor M21, thereby compensating the level of the reference voltage VR22 to variation of the external power voltage and change of circumstance temperature.

On the other hand, if the level of the reference voltage is lower than the desired voltage level, the lowered reference voltage VR2 is provided to the gate of the NMOS transistor M21 of the current adjusting means 218 so that its resistance becomes large. Accordingly, as the resistance of the NMOS transistor M21 becomes large, a voltage of the node Va21 becomes increased. The increased voltage at the node Va21 is provided to the gate of the NMOS transistor M14 of the comparator 213 so that the level of the reference voltage VR22 generated through the PMOS transistor M17 of the current driver 214 is increased. Therefore, when the level of the reference voltage VR22 generated through the current driver 214 is lower than the desired voltage level, the current sink 218 makes the level of the reference voltage VR22 increase through the NMOS transistor M21, thereby compensating the level of the reference voltage VR22 to variation of the external power voltage and change of circumstance temperature.

As above described, in accordance with the preferred embodiment, the resistor 215 for voltage-divider is connected to the NMOS transistor M21 for current sink in parallel the reference voltage generation portion 210 in the voltage amplification means 212 so that the reference voltage generation portion 210 compensates the level variation of the reference voltage VR2 generated from the current driver 214 and makes the level of the reference voltage VR22 be constant.

That is, when the level of the reference voltage is varied, the reference voltage generation portion 210 compensates the variation of the reference voltage through the NMOS transistor M21, thereby generating the reference voltage VR22 irregardless of variation of the external voltage and change of circumstance temperature. The capacitor 217 which a PMOS capacitor connected with the resistor 215 in parallel between the output node of the current driver 214 and the node Va for voltage divider plays a role in quickly compensating the level of the reference voltage VR22 to the level of the divided voltage Va21.

According to the present invention, in on-chip operation using an internal power voltage circuit which is a voltage down converter, it reduces the level variation of the reference voltage VR22 due to noise or temperature change to provide a stable internal power voltage to the on-chip, thereby resulting in compensation effect to noise or a temperature change.

While the invention has been particularly shown and described with respect to preferred embodiment thereof, it will be understood by those skilled in the art that various changes in form and details may be made therein without departing from the spirit and the scope of the invention as defined by the following claims.

What is claimed is:

1. A voltage down converter for converting an external power voltage into an internal power voltage and providing the internal power voltage to an internal circuitry, comprising:

a reference voltage generation means for receiving the external power voltage and generating a constant reference voltage where variation of the external power voltage and change of circumstance temperature are compensated, the reference voltage generation means including:

a generation means for reference voltage, which receives the external power voltage to generate a voltage based on the external power voltage, and a voltage amplification means for receiving the voltage from the generation means to generate the reference voltage where variation of the external power and change of circumstance temperature are compensated;

a reference voltage converting means for converting the reference voltage from the reference voltage generation means into a reference voltage for stress mode or a reference voltage for normal mode; and a driving means for receiving the reference voltage from the reference voltage converting means to generate the internal power voltage required to operation of the internal circuitry.

2. The voltage down converter as claimed in claim 1, wherein the voltage amplification means includes:

a voltage divider for voltage-dividing the reference voltage which is an output of the voltage amplification means;

a comparator for comparing an output of the voltage divider and the output of the generation means;

a current driver for generating the reference voltage where variation of the external power voltage and change of circumstance temperature are compensated in accordance with an output of the comparator; and a voltage level compensation means for compensating the reference voltage generated from the current driver to variation of the external power voltage and change of circumstance temperature.

3. The voltage down converter as claimed in claim 2, wherein the voltage divider is comprised of a first and a second resistors which is connected between the output of the current driver and a ground voltage and is for voltage-dividing the reference voltage generated from the current driver and providing a divided voltage to the comparator.

4. The voltage down converter as claimed in claim 2, wherein the current driver is comprised of a PMOS transistor which the output of the comparator is applied to a gate thereof and is connected between the external power voltage and the output of the current driver.

5. The voltage down converter as claimed in claim 2, wherein the voltage level compensation means includes:

a compensation means f or compensating the reference voltage from the current driver according to the divided voltage from the voltage divider; and a adjusting means for adjusting the divided voltage from the reference voltage to make the reference voltage generated the current driver have a constant level irregardless of variation of the external power voltage and change of circumstance temperature.

6. The voltage down converter as claimed in claim 5, wherein the compensation means is comprised of a NMOS capacitor connected with the first resistor in parallel.

7. The voltage down converter as claimed in claim 6, wherein the adjusting means is comprised of a NMOS current sink for adjusting the divided voltage, which is connected with the second resistor in parallel.

8. A voltage down converter for converting an external power voltage into an internal power voltage and providing the internal power voltage to an internal circuitry, comprising:

a reference voltage generation means for receiving the external power voltage and generating a constant reference voltage where variation of the external power voltage and change of circumstance temperature are compensated, the reference voltage generation means including a generation means for reference voltage, which receives the external power voltage to generate a voltage based on the external voltage; and a voltage amplification means for receiving the reference voltage from the generation means and an output signal of the reference voltage generation means to generate the reference voltage where variation of the external power voltage and change of circumstance temperature are compensated;

a reference voltage converting means for converting the reference voltage from the reference voltage generation means into a reference voltage for stress mode or a reference voltage for normal mode; and a driving means for receiving the reference voltage from the reference voltage converting means to generate the internal power voltage required to operation of the internal circuitry.

9. A voltage down converter for converting an external power voltage into an internal power voltage and providing the internal power voltage to an internal circuitry, comprising:

a reference voltage generation means for receiving the external power voltage and generating a constant reference voltage where variation of the external power voltage and change of circumstance temperature are compensated, the reference voltage generation means including a generation means for reference voltage for receiving the external voltage to generate a voltage based on the external voltage; a voltage divider for voltage-dividing the reference voltage; a comparator for comparing an output of the voltage divider and the output of the generation means; a current driver for generating the reference voltage where variation of the external power voltage and change of circumstance temperature are compensated in accordance with an output of the comparator; a capacitor for compensating the reference voltage from the current driver according to the divided voltage from the voltage divider; and a NMOS current sink for adjusting the divided voltage from the reference voltage to make the reference voltage generated the current driver have a constant level irregardless of variation of the external power voltage and change of circumstance temperature;

a reference voltage conversion means for the reference voltage from the reference voltage generation means into a reference voltage for stress mode or a reference voltage for normal mode; and a driving means for receiving the reference voltage from the reference voltage converting means to generate the internal power voltage required to operation of the internal circuitry;

wherein in case where the level of the reference voltage is higher than a desired voltage level, a resistance of the NMOS sink becomes decreased so that the divided voltage is lowered and the lowered divided voltage is provided to the comparator, thereby lowering the level of the reference voltage; and in case where the level of the reference voltage is lower than a desired voltage level, the resistance of the NMOS sink becomes increased so that the divided voltage is large and the large divided voltage is provided to the comparator, thereby increasing the level of the reference voltage.

* * * * *